US010429015B2

(12) United States Patent
Ke

(10) Patent No.: US 10,429,015 B2
(45) Date of Patent: Oct. 1, 2019

(54) LED ENERGY-SAVING LAMP, MANUFACTURING METHOD THEREOF AND CORN LAMP

(71) Applicants: ZHEJIANG SETEC LIGHTING CO., LTD, Zhejiang Province (CN); Jianfeng Ke, Zhejiang Province (CN)

(72) Inventor: Jianfeng Ke, Zhejiang Province (CN)

(73) Assignees: ZHEJIANG SETEC LIGHTING CO., LTD, Shaoxing, Zhejiang Province (CN); Jianfeng Ke, Shaoxing, Zhejiang Province (CN)

( * ) Notice: Subject to any disclaimer, the term of this patent is extended or adjusted under 35 U.S.C. 154(b) by 0 days.

(21) Appl. No.: 15/713,070

(22) Filed: Sep. 22, 2017

(65) Prior Publication Data

US 2018/0010742 A1 Jan. 11, 2018

Related U.S. Application Data

(63) Continuation-in-part of application No. PCT/CN2015/088518, filed on Aug. 31, 2015.

(30) Foreign Application Priority Data

Jun. 30, 2015 (CN) ..... 2015 2 0457950 U

(51) Int. Cl.
*F21S 2/00* (2016.01)
*F21K 9/90* (2016.01)
(Continued)

(52) U.S. Cl.
CPC ..... *F21S 2/00* (2013.01); *F21K 9/232* (2016.08); *F21K 9/90* (2013.01); *F21V 3/10* (2018.02);
(Continued)

(58) Field of Classification Search
CPC ..... F21Y 2115/10; G02B 6/0073; G02B 19/0066
(Continued)

(56) References Cited

U.S. PATENT DOCUMENTS 8,680,754 B2 * 3/2014 Premysler ..... F21V 29/402 313/46
2012/0014087 A1 * 1/2012 Wang ..... F21V 19/045 362/84
(Continued)

FOREIGN PATENT DOCUMENTS

CN 2805079 Y 8/2006
CN 201885005 U 6/2011
(Continued)

*Primary Examiner* — Edwyn Labaze
(74) *Attorney, Agent, or Firm* — Muncy, Geissler, Olds & Lowe, P.C.

(57) ABSTRACT

This invention provides an integrated LED energy-saving lamp, a manufacturing method thereof and a corn lamp. The LED energy-saving lamp comprises at least one tube, at least one baseplate, a plurality of LED lamp beads and a heat conductive adhesive. Each tube comprises two parallel first parts and a second part for connecting the two first parts. Each baseplate comprises two parallel branch parts, located on the same plane, and a connecting part for connecting with the two branches; the two branches are respectively located in the two first parts of the tube. The LED lamp beads are respectively arranged on the two branches. The heat conductive adhesive is pasted between the two branches and the internal wall of the tube.

15 Claims, 5 Drawing Sheets

(51) Int. Cl.

| | |
|---|---|
| ***F21K 9/232*** | (2016.01) |
| ***F21Y 115/10*** | (2016.01) |
| ***F21V 29/87*** | (2015.01) |
| ***F21V 3/10*** | (2018.01) |
| ***F21Y 103/37*** | (2016.01) |

(52) U.S. Cl.
CPC ..... *F21V 29/87* (2015.01); *F21Y 2103/37* (2016.08); *F21Y 2115/10* (2016.08)

(58) Field of Classification Search
USPC ..... 362/555, 551, 800
See application file for complete search history.

(56) References Cited

U.S. PATENT DOCUMENTS

2013/0058080 A1* 3/2013 Ge ..... F21V 3/00 362/231
2014/0168961 A1* 6/2014 Dubord ..... F21V 21/14 362/225
2016/0053948 A1* 2/2016 Wang ..... F21K 9/232 362/84
2016/0138774 A1* 5/2016 Joo ..... H01L 33/58 362/84
2016/0186969 A1* 6/2016 Zhao ..... F21K 9/27 362/221
2016/0351619 A1* 12/2016 Cramer ..... H04B 1/3888

FOREIGN PATENT DOCUMENTS

| | | | | | |
|---|---|---|---|---|---|
| CN | 202812851 | U | | 3/2013 | |
| CN | 103104823 | A | | 5/2013 | |
| CN | 203322802 | U | | 12/2013 | |
| CN | 103867991 | A | | 6/2014 | |
| CN | 203784667 | U | * | 8/2014 | |
| CN | 203927469 | U | | 11/2014 | |
| CN | 204062535 | U | | 12/2014 | |
| WO | WO-2016004705 | A1 | * | 1/2016 | ..... F21V 29/00 |

* cited by examiner

LED ENERGY-SAVING LAMP, MANUFACTURING METHOD THEREOF AND CORN LAMP

CROSS-REFERENCE TO RELATED APPLICATIONS

The present application is a Continuation-In-Part of International Application No. PCT/CN2015/088518 filed on Aug. 31, 2015, for which a priority is claimed under 35 U.S.C. § 120, the entire contents of all of which are hereby incorporated by reference.

BACKGROUND OF THE INVENTION

Field of the Invention

This invention relates to an LED lamp and, more particularly, to an LED energy-saving lamp, a manufacturing method thereof, and a corn lamp.

Description of the Related Art

Compared with the conventional illumination bulb lamps and the conventional glow energy-saving lamps, the LED energy-saving lamp is the first choice among the energy-saving lamps due to its low cost, high luminous effect, large light-emitting area, no glaring and no ghosting etc. The existing LED energy-saving lamp generally includes a tube, LED lamp beads, and an aluminum baseplate. The LED lamp beads are disposed on the aluminum baseplate in a welding or surface mounting process. One side of the aluminum baseplate without the LED lamp beads is pasted on the internal wall of the tube through the heat conductive adhesive. The aluminum baseplate is used as a circuit board, one end of which is welded with a drive module; therefore, the electrical connection between the drive module and the LED lamp beads is realized.

FIG. 1 is an aluminum baseplate adopted in the existing LED lamp. As shown in FIG. 1, the existing aluminum baseplate is of a straight strip shape. Most of the existing tubes are also straight-strip-shaped tubes; when the aluminum baseplate in the tube is fixed, a bearing rod of an adhesive spreader can carry the aluminum baseplate to insert into the tube, and the bearing rod directly passes through the straight-strip-shaped tube. At this moment, both ends of the bearing rod are fixed to ensure that the aluminum baseplate on the bearing rod is located on one horizontal surface. When the aluminum baseplate and the tube are glued together, the whole aluminum baseplate straight strip is uniformly stressed, so that the heat conductive adhesive can be uniformly pasted on the internal wall of the tube.

If users want to increase the illuminance of the existing LED lamps, generally a plurality of straight tubes or U-shaped or H-shaped tubes are additionally arranged. If U-shaped, H-shaped or other shaped tubes are adopted, one end of each tube is sealed and the bearing rod of the adhesive spreader cannot pass through the whole tube during adhesive spreading. In other words, only one end of the bearing rod is fixed, the other end is suspended in the air. When the tube is pressed downward to keep the internal wall and the aluminum baseplate pasted, one end of the bearing rod is suspended in the air and the other end is fixed, so that the two ends are not uniformly stressed. Therefore, the bearing rod and the aluminum baseplate on the bearing rod cannot be located in the same horizontal surface, which often results in the problems that the heat conductive adhesive on one end of the aluminum baseplate is successfully pasted on the internal wall of the tube while the heat conductive adhesive on the other end of the aluminum baseplate cannot come into contact with the internal wall of the tube or is not firmly pasted so as to form poor heat conduction. The existing LED lamp even has the problem: in order to ensure that the heat conductive adhesive on the whole aluminum baseplate is successfully pasted, too large force is applied and one end of the glass tube is crushed.

In addition, when the tube is U-shaped or H-shaped, one straight-strip-shaped aluminum baseplate is needed to be separately inserted into each branch of the U-shaped or H-shaped tube. The products of different production batches and made of different materials have differences, so that two aluminum baseplates inserted into the same tube have inevitable differences, and finally, the two branches of the U-shaped or H-shaped tube have different illumination brightness and colors. Not only the qualified rate but also the illumination effect of the products is influenced. Moreover, two aluminum baseplates are electrically connected with the drive module, respectively; the circuit wiring is more complex and the cost is higher.

Because the maximum light-emitting angle of the LED lamp is 120 degrees, in order to increase the light-emitting angle of the LED lamp, a way that the aluminum baseplates inserted in the two branches of the U-shaped or H-shaped tube are arranged in unparallel is adopt by those skilled in the art; for example, the aluminum baseplates are slightly inclined and one side having the LED lamp beads disposed thereon is inclined outward.

BRIEF SUMMARY OF THE INVENTION

In order to solve at least one problem in the prior art, the invention provides an LED energy-saving lamp, a manufacturing method thereof and a corn lamp.

The LED energy-saving lamp includes at least one tube, at least one baseplate, a plurality of lamp beads, and a heat conductive adhesive. Each of the at least one tube comprises two parallel first parts and a second part for connecting the two first parts. Each of the baseplates comprises two parallel branches located on the same plane and a connecting part for connecting with the two branches. The two branches are located at the two first parts of the tube, respectively. The LED lamp beads are disposed on the two branches, respectively. The heat conductive adhesive is pasted between the two branches and the internal wall of the tube.

In one embodiment of the invention, each branch may further include an extending part located inside the second part of the tube.

In one embodiment of the invention, the tube may be H-shaped, U-shaped, or H-shaped.

In one embodiment of the invention, the baseplate may be H-shaped, U-shaped, or H-shaped.

In one embodiment of the invention, the baseplate may be an aluminum plate, an epoxy plate, or a soft lamp strip.

In one embodiment of the invention, a cavity may be formed between each branch the internal wall of the tube, the cross section of the cavity may be D-shaped, and the D-shaped cavity may be filled with the heat conductive adhesive.

In one embodiment of the invention, the tube may be a glass tube, and a light dispersing agent may be sprayed inside or outside the glass tube.

In one embodiment of the invention, the LED energy-saving lamp may further include a drive module, which may be electrically connected with the LED lamp beads through the baseplate.

According to another aspect of the invention, the invention further provides a manufacturing method of the LED energy-saving lamp. The manufacturing method includes the following steps: at least one tube and at least one baseplate are manufactured, respectively; each of the at least one tube includes two parallel first parts and a second part for connecting the two first parts, each of the at least one baseplate comprises two parallel branches located on the same plane and a connecting part for connecting the two branches; a plurality of LED lamp beads are disposed on one side of the two branches, respectively; coating the heat conductive adhesive on a back of the side having the LED lamp beads disposed thereon; the tube or the baseplate is moved so that the internal wall of the tube approaches the back until each branch is pasted on the internal wall of the tube through the heat conductive adhesive.

In one embodiment of the invention, coating the heat conductive adhesive on the back of the side having the LED lamp beads disposed thereon may include the following steps: the side of the baseplate having the LED lamp beads disposed thereon is arranged to face down, the baseplate is arranged on a bearing rod of an adhesive spreader, and the heat conductive adhesive is coated on the backs of the two branches at the same time.

In one embodiment of the invention, inserting the branches of the baseplate into the first parts may include the following step: the bearing rod carrys the baseplate such that the two branches are inserted into the two first parts of the tube at the same time.

In one embodiment of the invention, the bearing rod is removed from the tube after moving the tube or the baseplate so that the internal wall of the tube approaches the back until each branch is pasted on the internal wall of the tube through the heat conductive adhesive.

In one embodiment of the invention, moving the tube or the baseplate so that the internal wall of the tube approaches the back until each branch is pasted on the internal wall of the tube through the heat conductive adhesive may include: pressing down the tube or moving up the baseplate until edges of each branch are against the internal wall of the tube and cavities are formed between the backs of the branches and the internal wall of the tube; the cross section of each of the cavities is D-shaped; the heat conductive adhesive is a semi-liquid adhesive, which is filled in the D-shaped cavities.

In one embodiment of the invention, the baseplate is welded and fixed on a drive module after the moving the tube or the baseplate so that the internal wall of the tube approaches the back until each branch is pasted on the internal wall of the tube through the heat conductive adhesive.

According to another aspect of the invention, the invention further provides an LED corn lamp, comprising a central column, at least four LED energy-saving lamps and a top lamp. The four LED energy-saving lamps are arranged around the central column, the side having the LED lamp beads disposed thereon of each LED energy-saving lamp faces outward, the back of the baseplate faces toward the central column. The top lamp is fixed on the central column.

In one embodiment of the invention, the numbers of the LED lamp beads on each branch of each LED energy-saving lamp are the same, and the number of the LED lamp beads of each top lamp is equal to that of the the LED lamp beads of each LED energy-saving lamp.

In one embodiment of the invention, the sum of the heights of the top lamp and the central column is slightly higher than the height of the tube of each LED energy-saving lamp.

To sum up, the baseplate in the invention comprises two branches and one connecting part integrally formed, and the whole baseplate is located on the same horizontal plane to ensure that all the LED lamp beads disposed thereon are located on the same horizontal plane. Therefore, all LED lamp beads emit light toward the same side, and all luminous dark areas are the backs. Two branches are directly made of the same material, so that the two branches have no difference and the LED lamp beads on the two branches have no difference in light-emitting brightness and colors during illumination. Because the existing baseplates are of a straight strip shape and the levelness of two baseplates cannot keep the same during the assembly of the LED energy-saving lamp, the LED lamp beads cannot emit light toward the same direction. In particular, those skilled in the art install the two baseplates aslant, although the illumination angle is bigger than that applied in the invention, within the original scope of the illumination angle, the illuminance is greatly reduced; moreover, the dark area always exists (the illumination angle of one row of the LED lamps is only 120 degrees and two rows of the LED lamps cannot achieve 360-degree illumination), and finally the bright area has not enough brightness and the dark area is still dark. In addition, the levelness of the baseplate of the invention can be ensured. Therefore, when the heat conductive adhesive 4 is coated, the entire heat conductive adhesive 4 can be uniformly filled between the whole branches and the internal wall of the tube, without causing the problems in the prior art that the heat conductive adhesive 4 is not uniformly coated due to non-uniform stressing and the thermal conduction is not uniform or the glass tube is damaged due to pressing. Moreover, if the existing straight baseplate is applied to a U-shaped, H-shaped or Π-shaped tube, two baseplates must be separately arranged, the circuit wiring is more complex, the process is more complicated, and the cost is increased accordingly. The connecting part is arranged in the invention, so that the tail ends of the two branches in need of being wired respectively can be wired unifiedly, so that the two branches can be directly connected to the drive module 5, the wiring layout is optimized, the process is simplified and the cost is reduced. In addition, the connecting part plays a role of fixing during installation.

DETAILED DESCRIPTION OF THE INVENTION

Figure 1:
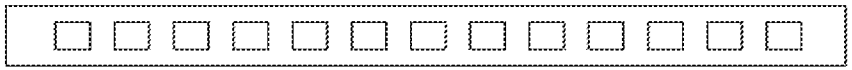
FIG.1 (PRIOR ART)
FIG. 1 is a structural schematic diagram of an existing straight-strip-shaped aluminum baseplate or epoxy plate.
Figure 2:
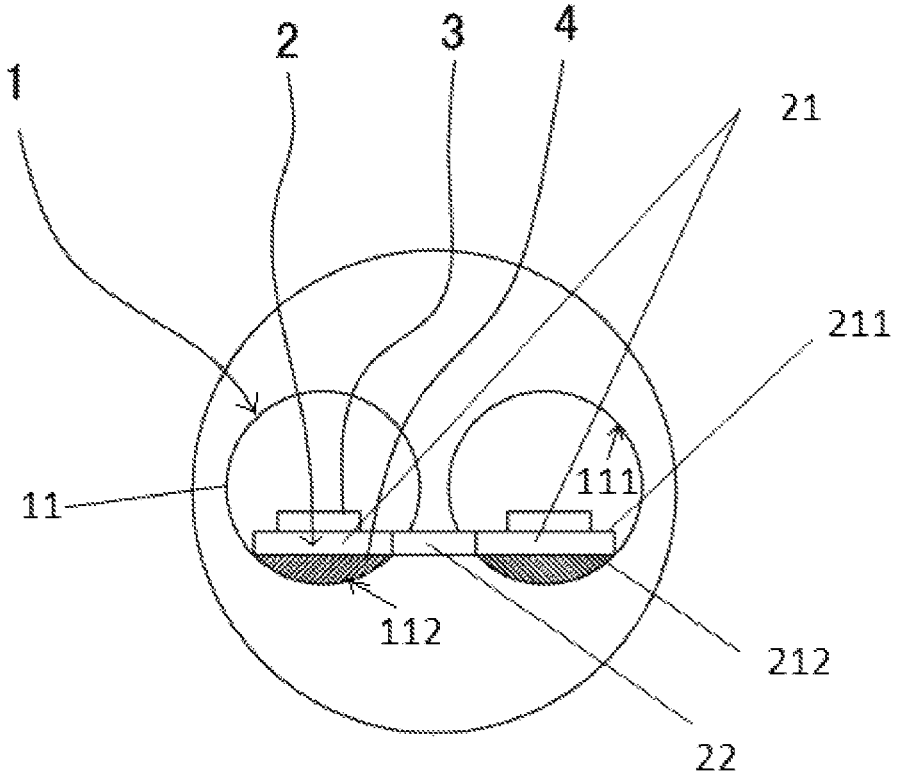
FIG. 2 is a structural schematic diagram of an LED energy-saving lamp provided by a first embodiment of the invention.
Figure 3:
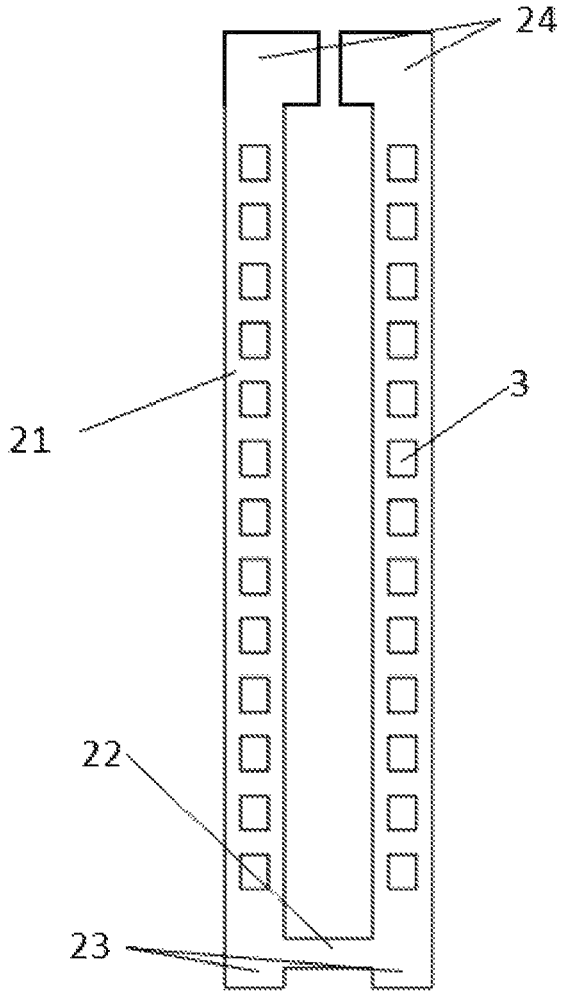
FIG. 3 is a structural schematic diagram of a baseplate provided by a second embodiment of the invention.
Figure 5:
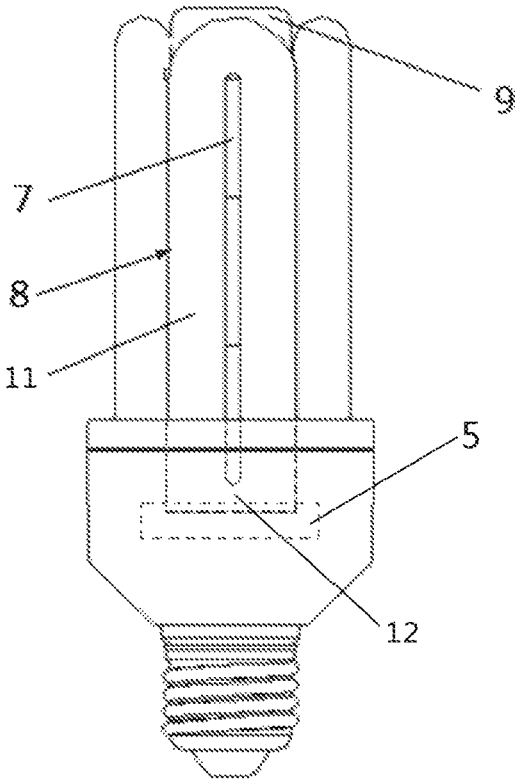
FIG. 5 is a structural schematic diagram of a corn lamp provided by one embodiment of the invention.

Please refer to FIG. 2, FIG. 3, and FIG. 5 together. The LED energy-saving lamp comprises at least one tube 1, at least one baseplate 2, a plurality of LED lamp beads 3 and a heat conductive adhesive 4. Only one tube 1 and one baseplate 2 are shown in the FIG. 2. However, the invention is not limited thereto. In other embodiments, the LED energy-saving lamp can consist of three tubes, the number of the baseplates corresponds to that of the tubes and is also three.

Each tube 1 includes two parallel first parts 11 and a second part 12 (as shown in FIG. 5) for connecting the two first parts 11. In the embodiment, the tube 1 is a glass tube. A light-dispersing agent, such as fluorescent powder, is sprayed inside or outside the glass tube. Compared with a full-plastic tube, the glass tube has better light transmission, is highly insulated and is heat conductive and durable. Compared with an aluminum-plastic tube, the glass tube has lower cost and is more environmental-friendly. In this embodiment, the tube 1 is U-shaped (as shown in FIG. 5). More particularly, the first parts 11 are the two branches of the U-shaped tube and the second part 12 is an arc-shaped part for connecting the two branches of the U-shaped tube. However, the invention is not limited thereto. In other embodiments, the tube 1 can be H-shaped, H-shaped or of other shapes.

Each baseplate 2 includes two parallel branches 21 located on the same plane and a connecting part 22 for connecting the two branches 21. In the embodiment, the baseplate 2 is an aluminum baseplate, including a circuit layer, an insulation layer, and a metal basic layer. However, the invention is not limited thereto. In other embodiments, the baseplate 2 can be an epoxy plate or a soft lamp strip.

In the embodiment, the baseplate 2 further includes two welding parts 23, which extend along the opposite directions of the branches 21. The branches 21, the connecting part 22, and the welding parts 23 are located on the same plane. In the embodiment, the whole baseplate 2 is H-shaped. In detail, two branches 21 are the two upper branches of the H shape, the connecting part 22 is the horizontal line of the H shape, and the two welding parts 23 are the two lower branches of the H shape. Since the length of the welding parts 23 is much shorter than that of the branches 21, the baseplate 2 is a non-standard H-shaped structure. However, the invention is not limited thereto. In other embodiments, the baseplate 2 can be U-shaped, H-shaped, or of other shapes. When the baseplate is U-shaped, the connecting part is the arc-shaped part of the U shape. Although no welding part is specially arranged under this condition, a part of the whole connecting part can be welded to a circuit board.

A plurality of the LED lamp beads 3 are disposed on the two branches 21, respectively. In the embodiment, the quantities of the LED lamp beads 3 on each branch 21 are the same. The heat conductive adhesive 4 is pasted between the two branches 21 and an internal wall 111 of the tube 1.

More particularly, the baseplate 2 is provided with a front 211 (the side 211 having the LED lamp beads 3 disposed thereon) and a back 212. The LED lamp beads 3 can be fixedly on the front 211 of each branch 21 by surface mounting or a welding process (the entire baseplate 2 is a plane, so that the front of each branch 21 is the front 211 of the baseplate). The heat conductive adhesive 4 is coated on the back 212 of each branch 21. Two branches 21 of the baseplate 2 are inserted into the two first parts 11 of the tube 1, and a cavity 112 is formed between each branch 21 and the internal wall 111 of the tube 1. The heat conductive adhesive 4 is of a semi-liquid shape, so that the heat conductive adhesive 4 fills the whole cavity 112 after being pressed by the baseplate 2.

In the embodiment, the cross section of each cavity 112 is D-shaped, and the D-shaped cavities 112 are filled with heat conductive adhesive 4. The heat conductive adhesive is solidified to be D-shaped finally, so that the thickness at the centre is higher than that at two sides. The thickest in the centre is just located on the back of the positions of the LED lamp beads 3. Since the central position of the baseplate 2 is at the highest temperature, the thermal precipitation performance of the heat conductive adhesive 4 in the invention is obviously better than that of the existing heat conductive adhesive 4 which has a uniform thickness. Moreover, the existing heat conductive adhesive in the form of pasting strip easily produces air bubbles during pasting, so that uniform thermal-conduction cannot be realized. The heat conductive adhesive in the invention is of a semi-liquid form and can be completely filled in the cavity, so that the production of air bubbles can be avoided.

In the embodiment, the LED energy-saving lamp further includes a drive module 5, which is electrically connected with the LED lamp beads 3 through the baseplate 2.

FIG. 3 is the structural schematic diagram of the baseplate provided by the second embodiment of the invention. In the embodiment, the baseplate further includes extending parts 24, and the extending parts are located in the second part 12 of the tube 1. The extending parts 24 are additionally arranged, so that the illuminance of the top end of the LED energy-saving lamp is increased and the problem of the dark area at the top end of the LED energy-saving lamp is solved.

Figure 4:
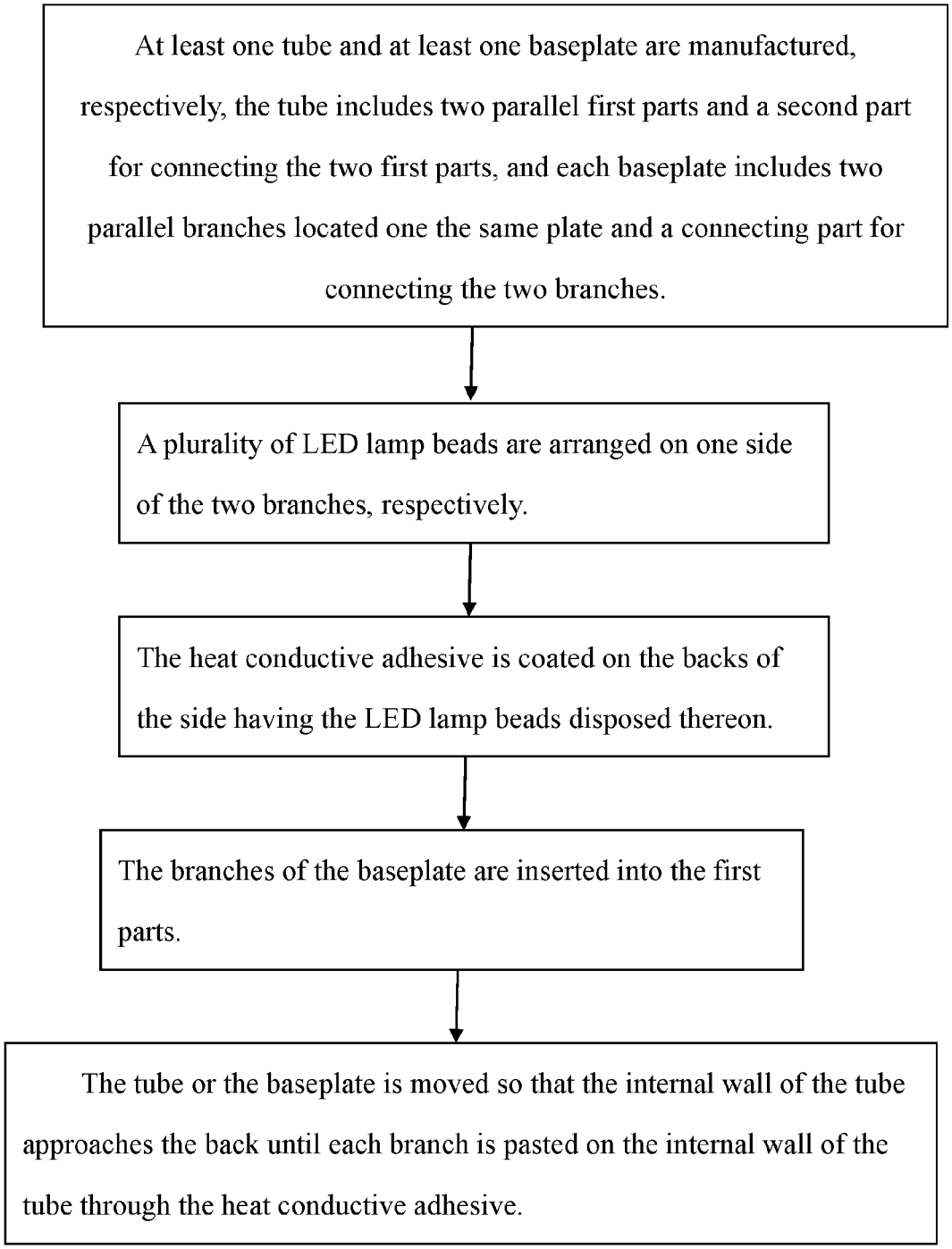
FIG. 4 is a manufacturing flow schematic diagram of the LED energy-saving lamp provided by one embodiment of the invention.

FIG. 4 is the production flow chart of the LED energy-saving lamp provided by one embodiment of the invention.

First of all, at least one tube 1 and at least one baseplate 2 are manufactured, respectively, each of the at least one tube 1 includes two parallel first parts 11 and a second part 12 for connecting the two first parts 11, and each baseplate 2 includes two parallel branches located on the same plane and a connecting part 22 for connecting the two branches 21.

A plurality of the LED lamp beads 3 are arranged on one side (that is the front 211) of the two branches 21, respectively. The heat conductive adhesive 4 is coated on the backs opposite to the front 211 having the LED lamp beads disposed thereon. The branches of the baseplate are inserted into the first parts of the tube, the tube or the baseplate is moved so that the internal wall of the tube approaches the back until each branch is pasted on the internal wall of the tube through the heat conductive adhesive.

In detail, the side of the baseplate having the LED lamp beads disposed thereon is arranged to face down, the baseplate is arranged on the bearing rod of an adhesive spreader, and the heat conductive adhesive is coated on the backs of the two branches at the same time. The bearing rod carrys the baseplate such that the two branches are inserted into the two first parts of the tube at the same time. The tube is pressed down or the baseplate is moved up until edges of each branch are against the internal wall of the tube and the D-shaped cavities are formed between the backs of the branches and the internal wall of the tube. Since the heat conductive adhesive 4 is a semi-liquid adhesive so that it can be filled in the D-shaped cavities. The bearing rod is removed from the tube, and the baseplate is welded and fixed on the drive module.

In the embodiment, adhesive-coating operation and adhesive-pasting operation on the two branches 21 are synchronously carried out. However, the invention has no limit in this aspect. In other embodiments, the heat conductive adhesive 4 on one branch 21 can be coated and pasted at first. Then the step is repeated and the heat conductive adhesive 4 on the other branch 21 is coated and pasted again.

FIG. 5 is the structural schematic diagram of the corn lamp. The corn lamp includes a central column 7, at least four LED energy-saving lamps 8, and a top lamp 9. The four LED energy-saving lamps 8 are arranged around the central column 7, the side of the baseplate having the LED lamp beads disposed thereon of each LED energy-saving lamp 8 is arranged outward, and the back of the baseplate faces toward the central column 7. As mentioned above, the LED lamp beads on two branches of the LED energy-saving lamp emit lights toward the same direction. Through this disposition, the light-emitting sides are uniformly arranged outward and the dark areas are arranged inward, so that accurate control and the illumination of the light-emitting area can be ensured. Meanwhile, in order to guarantee the uniform illumination of the whole corn lamp, the numbers of the LED lamp beads on each branch of each LED energy-saving lamp are the same, and the number of the LED lamp beads of each top lamp is equal to that of the LED lamp beads of each energy-saving lamp.

The glass at the top end of the LED energy-saving lamp is prone to be broken during transportation and installation. In order to avoid the problem as possible, the sum of the heights of the lamps and the central column in the embodiment is a little higher than the height of the tube of each LED light-emitting lamp, so that the top end of the LED energy-saving lamp is protected.

In conclusion, the baseplate 2 in the invention comprises two branches 21 and one connecting part 22 integrally formed, and the whole baseplate 2 is located on the same horizontal plane to ensure all the LED lamp beads 3 on the baseplate 2 are located on the same horizontal plane. Therefore, all LED lamp beads 3 emit light toward the same side and all light-emitting dark areas are the back sides. The two branches are directly made of the same material and have no difference, so that the LED lamp beads 3 on the two branches 21 have no difference in brightness and colors during illumination. The existing baseplates are of a straight strip shape and the levelness of two baseplates cannot be the same, so that the LED lamp beads 3 cannot emit light toward the same direction. In particular, those skilled in the art install the two baseplates aslant, although the illumination angle is bigger than that applied in the invention, within the original scope of the illumination angle. The illuminance is greatly reduced; moreover, the dark area always exists (the illumination angle of one row of the LED lamps is only 120 degrees and two rows of the LED lamps cannot achieve 360-degree illumination); finally, the bright area has not enough brightness and the dark area is still dark. In addition, the levelness of the baseplate 2 of the invention can be ensured. Therefore, when the heat conductive adhesive 4 is coated, the entire heat conductive adhesive 4 can be uniformly filled between the whole branches 21 and the internal wall 111 of the tube 1 without causing the problems in the prior art that the heat conductive adhesive 4 is not uniformly coated due to non-uniform stressing and the thermal conduction is not uniform or the glass tube is damaged due to pressing. Moreover, if the present straight baseplate is applied to a U-shaped, H-shaped or Π-shaped tube, two baseplates must be separately arranged, the circuit wiring is more complex, the process is more complicated, and the cost is increased accordingly. The connecting part 22 is arranged in the invention, so that the tail ends of the two branches 21 in need of being wired respectively in the prior art can be wired unifiedly, so that the two branches 21 can be directly connected to the drive module 5, the wiring layout is optimized, the process is simplified and the cost is reduced. In addition, the connecting part 22 during installation plays a role of fixing during installation.

What is claimed is:

1. A method for manufacturing an LED energy-saving lamp, the LED energy-saving lamp comprising at least one tube, at least one baseplate, a plurality of LED lamp beads and a heat conductive adhesive, wherein the at least one tube comprises two parallel first parts and a second part for connecting the two first parts, wherein the at least one baseplate comprises two parallel branches located on a same plane and a connecting part for connecting the two branches, and the two branches being located inside the two first parts of the tube, respectively, wherein the plurality of LED lamp beads are disposed on the two branches, respectively, wherein the heat conductive adhesive is pasted between the two branches and an internal wall of the tube, the method comprising the following steps:

manufacturing at least one tube and at least one baseplate, respectively, wherein each of the at least one tube comprises two parallel first parts and a second part for connecting the two first parts, each of the at least one baseplate comprises two parallel branches located on the same plane and the connecting part for connecting the two branches;

disposing a plurality of LED lamp beads on one side of the two branches, respectively;

coating the heat conductive adhesive on a back of the side having the LED lamp beads disposed thereon;

inserting the branches of the baseplate into the first parts; and moving the tube or the baseplate such that the internal wall of the tube approaches the back until each branch is pasted on the internal wall of the tube through the heat conductive adhesive;

wherein coating the heat conductive adhesive on the back of the side having the LED lamp beads disposed thereon comprises the following steps:

arranging the side having the LED lamp beads disposed thereon to face down, arranging the baseplate on a bearing rod of an adhesive spreader, and coating the heat conductive adhesive on the backs of the two branches at the same time.

2. The manufacturing method of the LED energy-saving lamp according to claim 1, wherein inserting the branches of the baseplate into the first parts comprises the following step:

wherein the bearing rod carries the baseplate such that the two branches are inserted into the two first parts of the tube at the same time.

3. The manufacturing method of the LED energy-saving lamp according to claim 1, wherein after moving the tube or the baseplate such that the internal wall of the tube approaches the back until each branch is pasted on the internal wall of the tube through the heat conductive adhesive, removing the bearing rod from the tube.

4. The manufacturing method of the LED energy-saving lamp according to claim 1, wherein moving the tube or the baseplate such that the internal wall of the tube approaches the back until each branch is pasted on the internal wall of the tube through the heat conductive adhesive comprises the following steps:

pressing down the tube or moving up the baseplate until edges of each branch are against the internal wall of the tube and cavities are formed between the backs of the branches and the internal wall of the tube; and wherein the cross section of each of the cavities is D-shaped, and the heat conductive adhesive is a semi-liquid adhesive filled in the D-shaped cavities.

5. The manufacturing method of the LED energy-saving lamp according to claim 1, wherein after moving the tube or the baseplate such that the internal wall of the tube approaches the back until each branch is pasted on the internal wall of the tube through the heat conductive adhesive, welding and fixing the baseplate on a drive module.

6. An LED corn lamp, comprising:

a central column;

at least four LED energy-saving lamps arranged around the central column, each of the four LED energy-saving lamps comprising:

at least one tube, comprising two parallel first parts and a second part for connecting the two first parts;

at least one baseplate, comprising two parallel branches located on a same plane and a connecting part for connecting the two branches, and the two branches being located inside the two first parts of the tube, respectively;

a plurality of LED lamp beads disposed on the two branches, respectively; and a heat conductive adhesive pasted between the two branches and an internal wall of the tube;

wherein the side having the LED lamp beads disposed thereon of the baseplate of each LED energy-saving lamp faces outward, and the back of the baseplate faces toward the central column; and a top lamp fixed on the central column.

7. The LED corn lamp according to claim 6, wherein the numbers of the LED lamp beads on each branch of each LED energy-saving lamp are the same, and the number of the LED lamp beads of each top lamp is equal to that of the LED lamp beads of each LED energy-saving lamp.

8. The LED corn lamp according to claim 6, wherein the sum of the heights of the top lamp and the central column is slightly higher than the height of the tube of each LED energy-saving lamp.

9. The LED corn lamp according to claim 6, wherein each branch further comprises an extending part, and the extending part is located inside the second part of the tube.

10. The LED corn lamp according to claim 6, wherein the tube is H-shaped, U-shaped, or Π-shaped.

11. The LED corn lamp according to claim 6, wherein the baseplate is H-shaped, U-shaped, or Π-shaped.

12. The LED corn lamp according to claim 6, wherein the baseplate is an aluminum plate, an epoxy plate, or a soft lamp strip.

13. The LED corn lamp according to claim 6, wherein a cavity is formed between each branch and the internal wall of the tube, a cross section of the cavity is D-shaped, and the D-shaped cavity is filled with the heat conductive adhesive.

14. The LED corn lamp according to claim 6, wherein the tube is a glass tube, and a light dispersing agent is sprayed inside or outside the glass tube.

15. The LED corn lamp according to claim 6, wherein the LED energy-saving lamp further comprises a drive module, and the drive module is electrically connected with the LED lamp beads through the baseplate.

* * * * *